US009157445B2

(12) United States Patent
Wang

(10) Patent No.: US 9,157,445 B2
(45) Date of Patent: Oct. 13, 2015

(54) CEILING FAN BLADE

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 464 days.

(21) Appl. No.: 13/755,253

(22) Filed: Jan. 31, 2013

(65) Prior Publication Data

US 2014/0212294 A1 Jul. 31, 2014

(51) Int. Cl.

| | |
|---|---|
| ***F01D 5/30*** | (2006.01) |
| ***F04D 25/08*** | (2006.01) |
| ***F04D 29/38*** | (2006.01) |

(52) U.S. Cl.

CPC ..... *F04D 25/088* (2013.01); *F04D 29/388* (2013.01)

(58) Field of Classification Search

CPC ..... F04D 25/08; F04D 25/088; F04D 29/388; F04D 29/329; F04D 29/325; F01D 5/14

USPC ..... 416/5, 204 R, 210 R

See application file for complete search history.

(56) References Cited

U.S. PATENT DOCUMENTS 5,338,156 A * 8/1994 Chien ..... 416/132 A

* cited by examiner

*Primary Examiner* — Craig Kim
*Assistant Examiner* — Maxime Adjagbe
(74) *Attorney, Agent, or Firm* — Ming Chow; Sinorica, LLC

(57) ABSTRACT

A ceiling fan blade includes a lower blade and an upper blade combined together. The lower blade is provided with a recess and secured thereon with a plurality of engage fasteners, and the upper blade is formed with a recess and embedded therein with a plurality of engage posts respectively corresponding with the engage fasteners. The engage post is engaged with the engage fastener to form a one-way engagement for reinforcing combination of the upper blade with the lower blade. The ceiling fan blade of this invention can not only conform to environmental protection but also avoid being broken apart when used to insure safety in use. In addition, the ceiling fan blade of this invention is hollow in structure, able to lighten the blade, and no locking member is provided on the surface of the blade, able to keep beautiful external features of the ceiling fan.

6 Claims, 6 Drawing Sheets

CEILING FAN BLADE

BACKGROUND OF THE INVENTION

1. Field of the Invention

This invention relates to a ceiling fan blade.

2. Description of the Prior Art

A common ceiling fan includes a motor having a rotating shaft provided thereon with a plurality of blade holders respectively secured with a blade so that the blades of the ceiling fan can be driven to rotate by the motor and, for facilitating the blades to be driven to rotate by the motor, the common ceiling fan blade is hollow in structure in order to lighten the blade. A conventional ceiling fan blade is generally composed of an upper blade and a lower blade stuck and combined together by means of adhesives and having an accommodating space formed between the upper and the lower blades.

However, a great quantity of adhesive must be employed for sticking and combining the upper blade and the lower blade of the conventional ceiling fan together and thus, it is not only unfriendly to the environment but also likely to cause degumming to the blades and render the blades burst apart to endanger users when the conventional ceiling fan blades are used. Although locking members can be used to lock the upper and the lower blades together and reinforce their combination, yet the locking members, after locked, will be exposed to the surface of the blade to spoil the external looks of the conventional ceiling fan. Therefore, having been devoted to research and production of various kinds of ceiling fans and related parts for many years and having much experience in marketing, the inventor of this invention thinks that it is really necessary to ameliorate the conventional ceiling fan blade and devise an ideal ceiling fan blade.

SUMMARY OF THE INVENTION

This invention is devised to offer a ceiling fan blade composed of an upper blade and a lower blade firmly combined together via one-way engagement, able to reinforce combination of the upper blade with the lower blade. The ceiling fan blade is hollow in structure and no locking member is provided on the surface of the blade, able to lighten the blade and keep the beautiful external features of the ceiling fan.

The ceiling fan blade in the present invention includes a lower blade, at least one engage fastener and an upper blade combined together. The lower blade is formed with a recess secured therein with at least two lower studs. The engage fastener has two ends fixedly assembled on the lower studs, formed in the center with an engage portion with an insert hole having an outer circumferential edge provided with a plurality of radial slits extending outward. The upper blade to be combined on the lower blade is disposed with a recess fixed therein with at least one upper stud corresponding to a location between the lower studs of the lower blade. An engage post has one end embedded in the upper stud and another end protruding out of the upper stud to be engaged in the insert hole of the engage fastener to form engaging action for securing the lower blade together with the upper blade.

The ceiling fan blade of this invention is to have the engage posts respectively engaged with the engage fasteners to form one-way engagement for securing the upper blade on the lower blade, able to reinforce combination of the upper blade with the lower blade. The ceiling fan blade of this invention is not only friendly to the environment but also able to avoid being broken apart when used to insure safety in use. In addition, the ceiling fan blade of this invention is hollow in structure, able to lighten the blade, and there is no locking member on the surface, able to maintain beautiful appearance of the blade.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
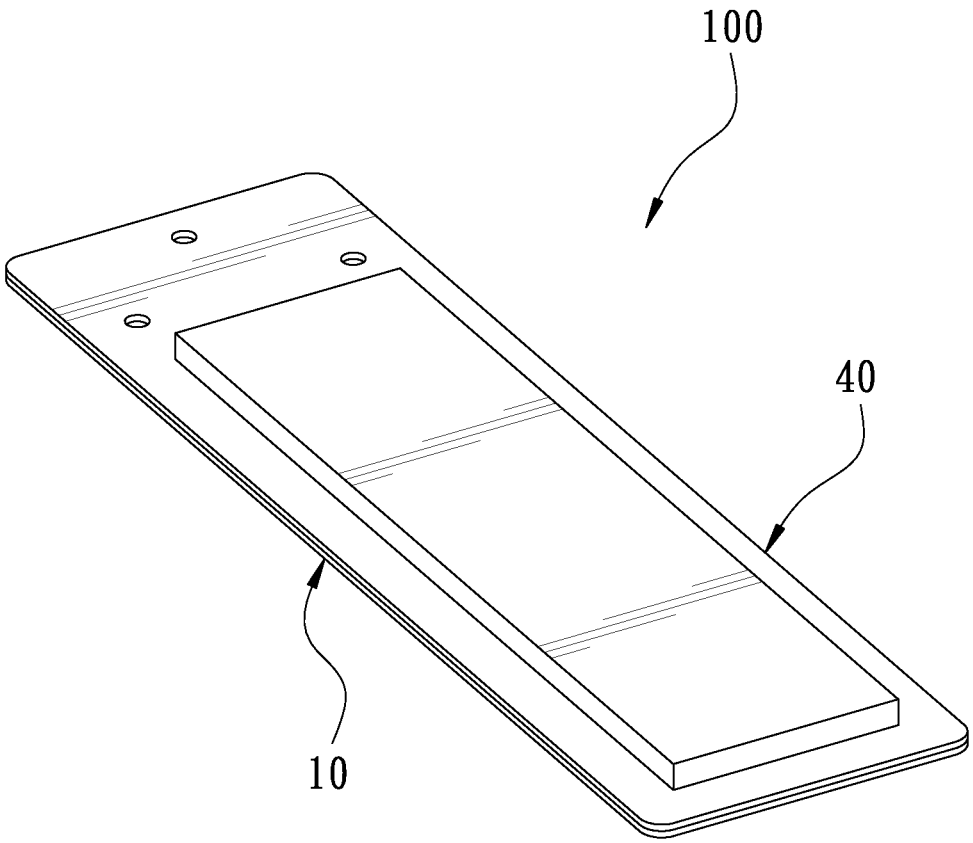
FIG. 1 is a perspective view of a ceiling fan blade in the present invention.
Figure 2:
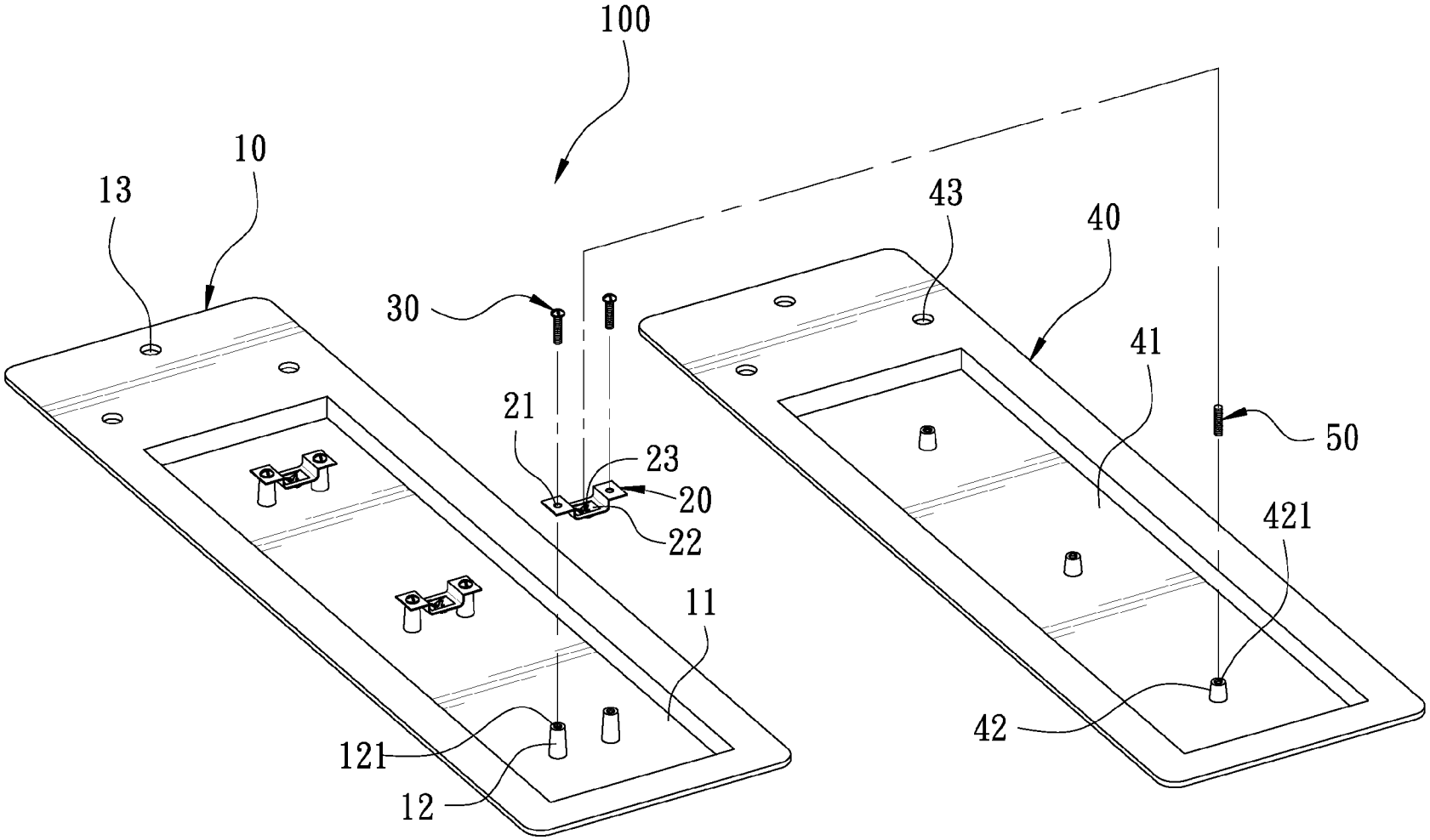
FIG. 2 is an exploded perspective view of the ceiling fan blade in the present invention.

A preferred embodiment of a ceiling fan blade 100 in the present invention, as shown in FIGS. 1 and 2, includes a lower blade 10, a plurality of engage fasteners 20, a plurality of locking members 30, an upper blade 40 and a plurality of engage posts 50 as main components combined together.

The lower blade 10 is formed with a recess 11 fixed therein with plural pairs of lower studs 12 spaced apart equidistantly and respectively having a topside disposed with a threaded hole 121. The lower blade 10 further has one end bored with a plurality of through holes 13.

Figure 3:
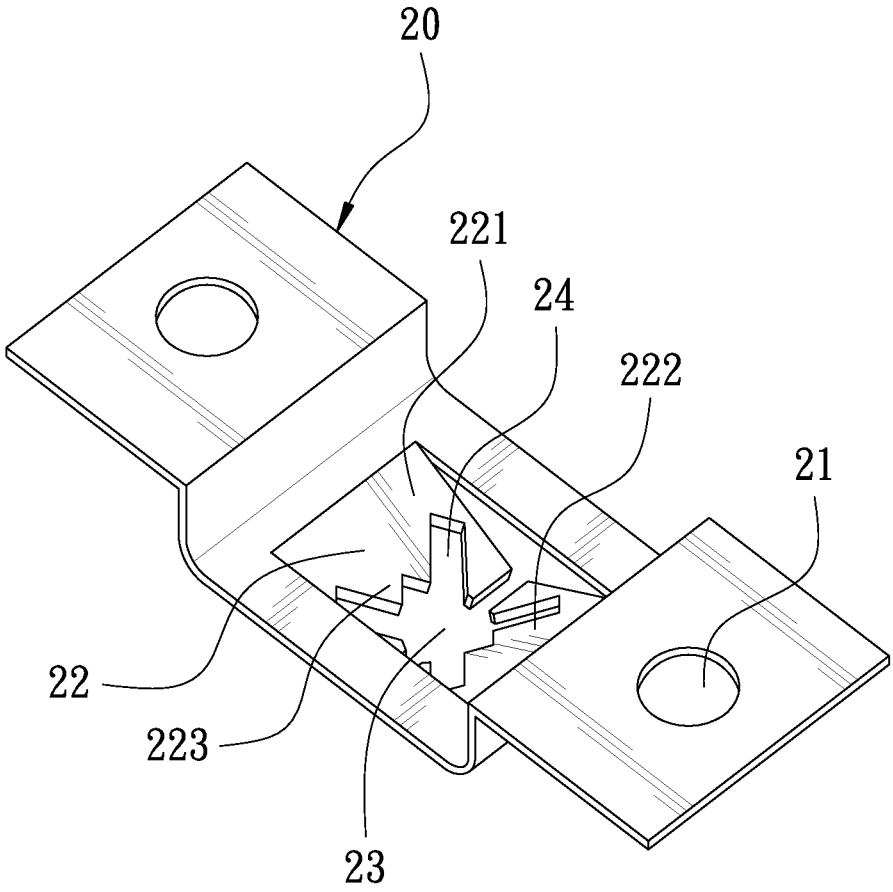
FIG. 3 is a perspective view of an engage fastener in the present invention.

The engage fasteners 20, referring to FIG. 3, are metal plates formed integral by compression. Each engage fastener 20 has two ends respectively provided with a locking hole 21 to be secured with the lower stud 12 of the lower blade 10, and a central part formed with an engage portion 22 composed of a left engage plate 221 and a right engage plate 222. One end of the left engage plate 221 is a fixed end secured with the engage fastener 20 and another end is a free end, while one end of the right engage plate 222 is a fixed end secured with the engage fastener 20 and another end is a free end, the free end of the left engage plate 221 and the free end of the right engage plate 222 being adjacent to each other and respectively slanting downward. Further, the engage portion 22 is bored with an insert hole 23 located between the left engage plate 221 and the right engage plates 222 and formed at the correspondingly peripheral walls of the free ends of the left engage plate 221 and the right engage plate 222. Furthermore, the free ends of both the left engage plate 221 and the right engage plate 222 are formed with serrated edges 223 at a location of the outer circumferential edge of the insert hole 23, and the insert hole 23 has its outer circumferential edge provided with four radial slits 24 extending outward equiangularly and respectively having a proper width.

The locking members 30 are respectively to be inserted through the locking holes 21 of the engage fastener 20 and threadably locked in the threaded holes 121 of the lower studs 12 of the lower blade 10 for fixing the engage fastener 20 on the lower studs 12 of the lower blade 10. In this preferred embodiment, the locking members 30 are bolts, but this is merely one embodiment not confined to the mode of this invention.

Figure 4:
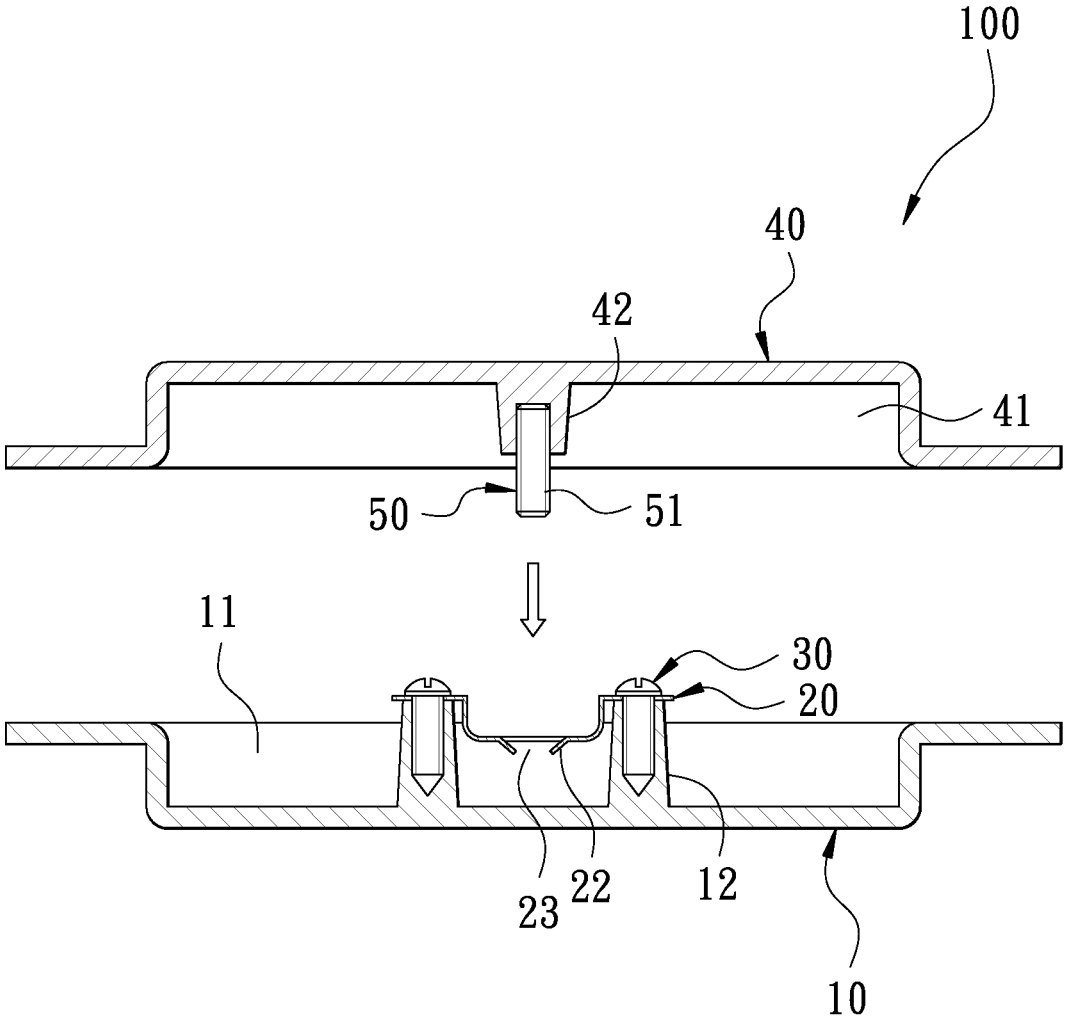
FIG. 4 is a cross-sectional view of an upper blade and a lower blade to be combined together in the present invention.

The upper blade 40, referring to FIG. 4, is to be positioned on and combined with the lower blade 10, formed with a recess 41 fixed therein with a plurality of upper studs 42 spaced apart equidistantly and respectively corresponding to a location between the pair of lower studs 12 of the lower blade 10. In addition, the upper blade 40 has one end bored with a plurality of through holes 43 respectively corresponding and communicating with the through holes 13 of the lower blade 10.

The engage posts 50 respectively have one end embedded in the upper stud 42 and another end extending out of the upper stud 42 to be inserted in the insert hole 23 and engaged with the engage fastener 20 for securing the lower blade 10 together with the upper blade 40. The engage posts 50 have their surfaces respectively formed with threads 51.

In assembling, referring to FIGS. 2 and 4, firstly, the locking members 30 are respectively inserted through the locking holes 21 of the engage fastener 20 and screwed with the threaded holes 121 of the lower studs 12 to firmly lock the engage fastener 20 on the lower studs 12, and the engage posts 50 of the upper blade 40 are respectively and correspondingly engaged in the insert holes 23 of the engage fasteners 20. After engaged in the insert holes 23, the engage post 50 and the engage portion 22 will form a one-way engagement by the slanting-downward engage portion 22 for engaging and fixing the lower blade 10 together with the upper blade 40 and thus, the upper blade 40 can be firmly engaged on the lower blade 10 and their combination can be reinforced via the one-way engagement. By so designing, the ceiling fan blade 100 of this invention is needless to employ adhesives for combining the upper blade 40 together with the lower blade 10, able to tally with environmental protection, avoiding the blade being broken apart when used and insuring safety in use.

Figure 5:
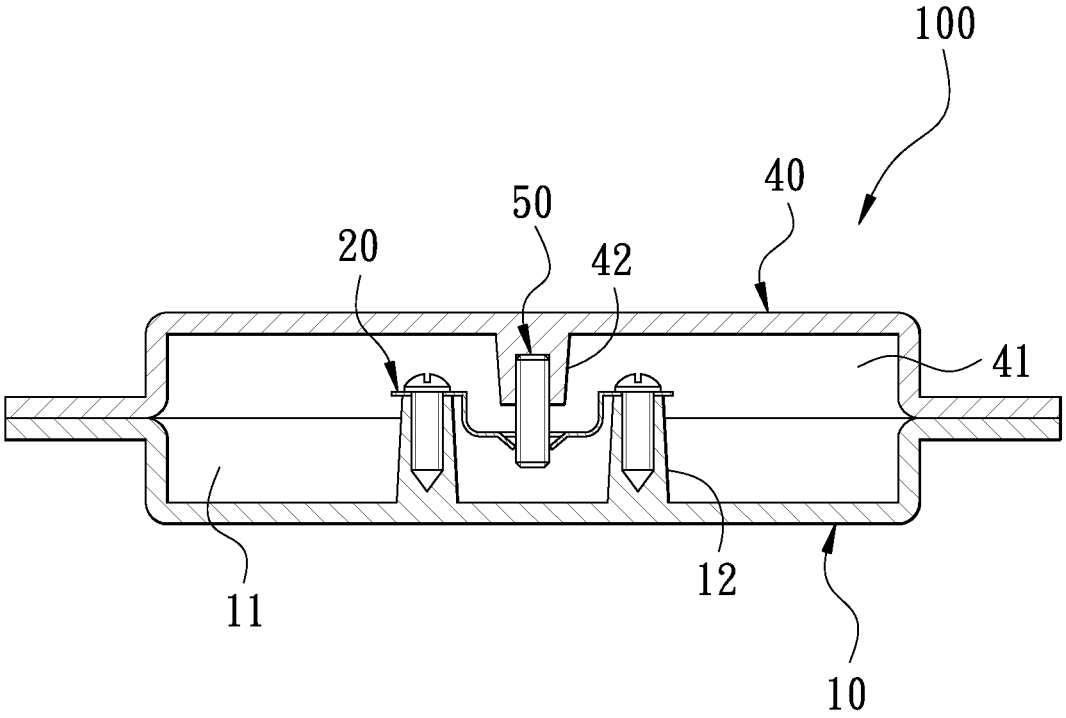
FIG. 5 is a cross-sectional view of the ceiling fan blade in the present invention, illustrating a combined on condition of the upper and the lower blades.

Referring to FIG. 5, the one-way engagement of the engage posts 50 with the engage fastener 20 enables the upper blade 40 to be firmly fixed on the lower blade 10 to make up the ceiling fan blade of this invention. Moreover, the recess 11 of the lower blade 10 and the recess 41 of the upper blade 40 are correspondingly combined together to form an accommodating space so the ceiling fan blade 100 of this invention is hollow in structure, able to lighten the ceiling fan blade 100. Additionally, the upper blade 40 and the lower blade 10 are combined together to make up the ceiling fan blade 100 via the one-way engagement of the engage posts 50 with the engage fasteners 20; therefore, there is not any locking member exposed to the surface of the ceiling fan blade 100, able to maintain beautiful external appearance of the ceiling fan blade 100.

Figure 6:
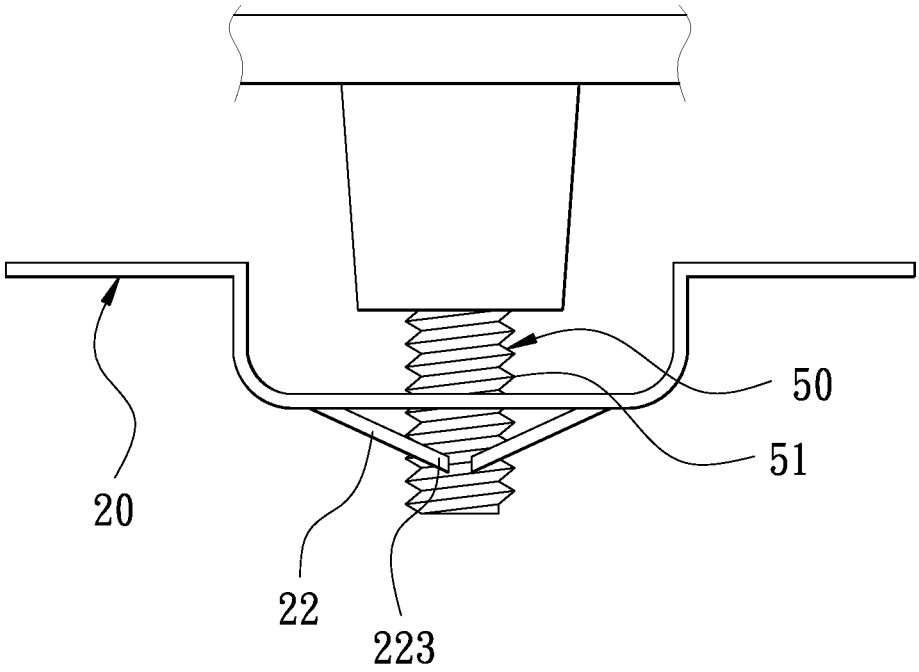
FIG. 6 is a partial magnified view showing that an engage post of the upper blade is engaged in an insert hole of an engage fastener secured on the lower blade in the present invention.

Referring to FIGS. 3 and 6, the diameter of the engage post 50 is a little larger than that of the insert hole 23 of the engage fastener 20; therefore, when engaged in the insert hole 23, the engage post 50 will force the engage portion 22 to slant downward and simultaneously, the engage portion 22 will elastically resist against the engage post 50 by its restoring force and form engaging action to enable the engage post 50 to be engaged in the insert hole 23 of the engage fastener 20 along the slanting-downward engage portion 22. Thus, the engage post 50 is unable to withdraw out of the insert hole 23, letting the engage fastener 20 produce a marked effect of one-way engagement. In the preferred embodiment of this invention, the engage portion 22 of the engage fastener 20 is provided slanting downward so that the engage post 50 can be engaged into the insert hole 23 easier.

One special feature of this invention is that the free ends of both the left engage plate 221 and the right engage plate 222 have their peripheral edges respectively serrated, and the surface of the engage post 50 is provided with threads 51, able to enhance engaging effect, reinforce one-way engagement of the engage post 50 with the engage portion 22 and enable the engage post 50 to be stably engaged with the engage fastener 20 for insuring safety in use of the ceiling fan blades 100.

While the preferred embodiment of the invention has been described above, it will be recognized and understood that various modifications may be made therein and the appended claims are intended to cover all such modifications that may fall within the spirit and scope of the invention.

What is claimed is:

1. A ceiling fan blade comprising:

a lower blade formed with a recess, said recess fixed therein with at least two lower studs;

at least one engage fastener, said engage fastener being a metal plate, said engage fastener having two ends respectively secured on said at least two lower studs, said engage fastener formed with an engage portion in a center, said engage portion disposed with an insert hole, said insert hole having an outer circumferential edge provided with a plurality of radial slits extending outward;

an upper blade positioned on said lower blade to be combined with said lower blade, said upper blade formed with a recess, said recess fixed therein with at least one upper stud, said at least one upper stud corresponding to a location between said at least two lower studs; and at least one engage post, said engage post having one end embedded in said at least one upper stud, said engage post having another end protruding out of said at least one upper stud to be engaged in said insert hole of said engage fastener for securing said lower blade and said upper blade together.

2. The ceiling fan blade as claimed in claim 1, wherein said engage portion is composed of a left engage plate and a right engage plate, one end of said left engage plate being a fixed end secured with said engage fastener and another end being a free end, one end of said right engage being a fixed end secured with said engage fastener and another end being a free end, said free end of said left engage plate and said free end of said right engage plate being adjacent to each other, said free end of said left engage plate and said free end of said right engage plate respectively slanting downward.

3. The ceiling fan blade as claimed in claim 2, wherein said free end of said left engage plate and said free end of said right engage plate have their corresponding peripheral walls formed with an insert hole, said free end of said left engage plate and said free end of said right engage plate formed with serrated edges at an outer circumferential edge of said insert hole.

4. The ceiling fan blade as claimed in claim 1, wherein said engage post is provided with threads on the surface.

5. The ceiling fan blade as claimed in claim 1, wherein said engage fastener has two ends respectively disposed with a locking hole for fixing said engage fastener on said at least two lower studs of said lower blade, and said at least two lower studs of said lower blade have their topsides respectively bored with a threaded hole, plural locking members employed to lock said engage fastener on said at least two lower studs, said locking members being bolts.

6. The ceiling fan blade as claimed in claim 1, wherein said lower blade has one end bored with at least one through hole, and said upper blade has one end provided with at least one through hole, said through hole of said upper blade and said through hole of said lower blade corresponding and communicating with each other.

* * * * *